United States Patent [19]

Treyssac

[11] 4,146,472

[45] Mar. 27, 1979

[54] PROCESS AND APPARATUS FOR SEPARATING MATTER IN SUSPENSION IN A LIQUID

[75] Inventor: Georges M. Treyssac, Marcq en Baroeul, France

[73] Assignee: Societe Anonyme d'Etudes, de Recherches et de Productions d'Agents Chimiques-E.R.P.A.C., Paris, France

[21] Appl. No.: 872,874

[22] Filed: Jan. 27, 1978

[30] Foreign Application Priority Data

Mar. 8, 1977 [FR] France ..... 77 06748

[51] Int. Cl.[2] ..... B03D 1/00

[52] U.S. Cl. ..... 210/44; 210/101; 210/137; 210/221 P; 209/170

[58] Field of Search ..... 210/44, 101, 137, 221 P; 209/164, 170

[56] References Cited

U.S. PATENT DOCUMENTS

| | | | |
|---|---|---|---|
| Re. 26,329 | 1/1968 | Hougen | 210/44 |
| 1,638,977 | 8/1927 | Avery | 210/44 |
| 2,983,677 | 5/1961 | Boyd | 210/44 |
| 3,479,281 | 11/1969 | Kikindat | 210/44 |
| 3,754,656 | 8/1973 | Horiguchii | 210/221 P |

FOREIGN PATENT DOCUMENTS

| | | | |
|---|---|---|---|
| 2280817 | 7/1974 | France. | |
| 493440 | 3/1976 | U.S.S.R. | 210/221 P |

*Primary Examiner*—Charles N. Hart
*Assistant Examiner*—Ernest G. Therkorn
*Attorney, Agent, or Firm*—Oblon, Fisher, Spivak, McClelland & Maier

[57] ABSTRACT

A flotation apparatus comprising a treatment chamber provided, at one of its ends, with an inlet for the liquid to be treated circulating without turbulence and, at the other end, an outlet for the treated liquid, an inlet pipe for the treatment water under high compression charged with gas being disposed at the lower part of said treatment chamber.

In this apparatus the inlet pipe for the water under high compression is located below and in the neighborhood of the inlet for the liquid to be treated in the treatment chamber, an outlet pipe for the treatment water being disposed at the lower part of the chamber, below and in the neighborhood of the outlet for the treated liquid, means for allowing the passage of the micro-bubbles coming from the water under high compression being furthermore provided to create between the two ends of the chamber two distinct, superimposed and parallel flows, the upper one for the liquid to be treated, the lower one for the water under high compression.

For the treatment of waste water from different industries.

11 Claims, 1 Drawing Figure

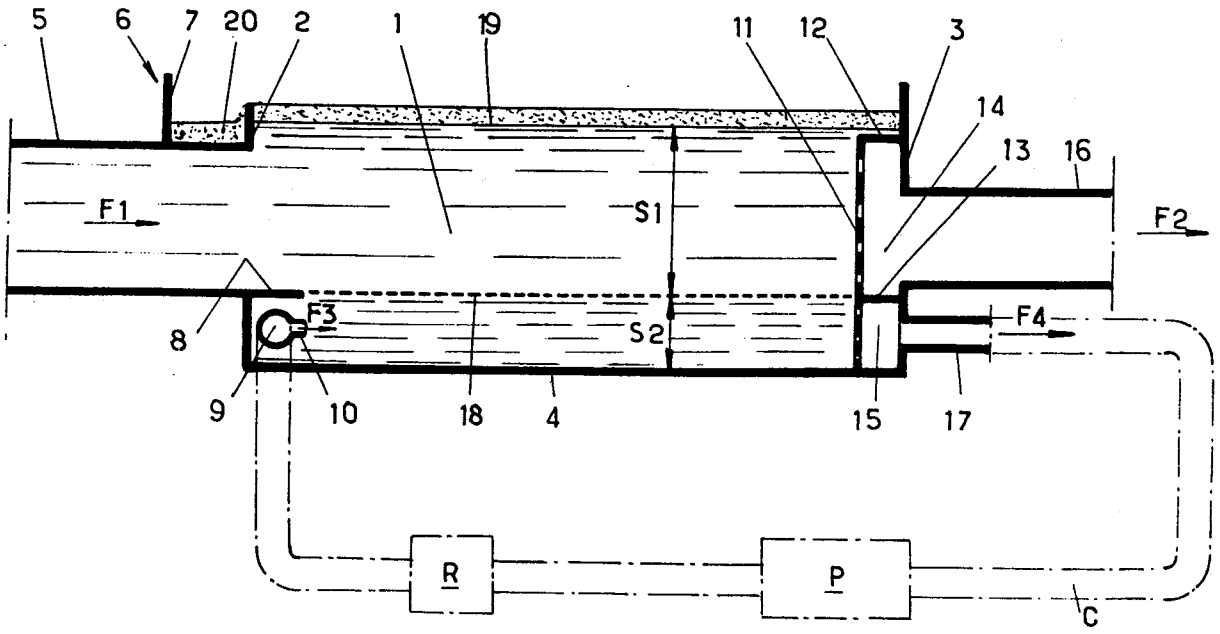
F2
16
13
14
3
12
11
19
1
2
20
7
6
5
F1
F4
17
15
S1
S2
4
18
F3
10
9
8
C
P
R

PROCESS AND APPARATUS FOR SEPARATING MATTER IN SUSPENSION IN A LIQUID

The present invention has as its object a process and a device for separating matter in suspension in a liquid, such as floccules in suspension in water, consisting of treating this liquid with particles, particularly gaseous particles, which moving under the effect of gravity carry along the matter in suspension.

In the processes and devices of this type known up to present and used for the treatment of waste water from different industries, the particles, when they are solid, may come from sludge mixed with the liquid to be treated containing matter in suspension.

When they are gaseous, they come generally from a liquid under high compression charged with gas, mixed with the liquid to be treated.

These different processes have however certain disadvantages. First of all, the liquid containing the particles mixes with the liquid to be treated and dilutes it, which decreases the efficiency. Then, the operation of mixing the sludge with the liquid to be treated and the sudden arrival of the liquid under high compression in the liquid to be treated, as well as the turbulence which results therefrom, tend to cause the breaking up of the matter in suspension, which makes their separation very problematical.

The invention has as its object to remedy these disadvantages and to do this it has in view a separation process which is characterised in that it consists in causing the liquid to be treated and a fluid of the same density charged with said particles to circulate in two superimposed, distinct and parallel flows, so that the particles contained in said fluid pass through said liquid to be treated under the action of gravity.

When it is more particularly a question of treating a liquid containing floccules in suspension with solid particles, the liquid to be treated forms the lower flow, the upper flow being formed by dense solid particles in suspension in a gas or in a liquid. These particles progressively settle taking with them in their passage the floccules in suspension.

On the other hand, when it is a question of treating this same liquid with gaseous particles, the liquid to be treated form the upper flow, the lower flow being water under high compression charged with gas, particularly air. The depressurisation of this latter causes the formation of micro-bubbles which adhere to the floccules in suspension and thus decrease their density.

The flotation apparatus for implementing this latter process which comprises a treatment chamber provided, at one of its ends, with an inlet for the liquid to be treated circulating without turbulence and, at the other end, an outlet for the treated liquid, an inlet pipe for the treatment water under high compression charged with gas being disposed at the lower part of said treatment chamber, is characterised in that said inlet pipe for water under high compression is located below and in the neighbourhood of the inlet for the liquid to be treated in the treatment chamber, an outlet pipe for the treatment water being disposed at the lower part of the chamber, below and in the neighbourhood of the outlet for the treated liquid, means allowing the microbubbles coming from the water under high compression to pass being furthermore provided for creating, between the two ends of the chamber, two distinct, superimposed and parallel flows, the upper one for the liquid to be treated, the lower one for the water under high compression.

Owing to this arrangement, the treatment liquid does not mix with the treated liquid. Moreover, no turbulence appears in this latter during the whole of the treatment, which results in the matter in suspension keeping the cohesion which it had on arrival and is then easily carried along by the gaseous micro-bubbles.

According to a preferred embodiment of the invention, the means for creating two distinct, superimposed and parallel flows comprise a device for regulating the flow of water under high compression adjusted so that the flow rate of this water is equal to the flow rate of the liquid to be treated.

In this case, it is preferred that the inlet pipe for the water under high compression be formed by a tube fed with water under high compression whose axis is perpendicular to the direction of movement of the liquid to be treated, this tube being split along its whole length so that the water under high compression flows therefrom in a direction substantially parallel to the direction of movement of the liquid to be treated.

Advantageously, the tube has a square section, the split being then just below the level of the upper edge of said tube, the upper wall of this latter being possibly extended over a short distance to form a visor above the slit. This arrangement allows the water under high compression to undergo a prior partial expansion in the tube before it flows therefrom at a reduced speed unlikely to cause turbulences.

Thus we have two superimposed liquid flows both penetrating without turbulence into the treatment chamber and which are of the same density. Experience has shown that these liquid flows, when their speeds are equal, circulate one above the other as far as the outlet without appreciable interpenetration, i.e. remaining distinct from each other all along their path. This being so, it is clear that the treatment water creates no turbulence in the water to be treated, whereas the micro-bubbles freed by the treatment water travel progressively and evenly through the water to be treated.

According to another embodiment of the invention, the means for creating two distinct, superimposed and parallel flows comprise a grid disposed between the flow of liquid to be treated and the flow of water under high compression.

Preferably, the diameter of the wires forming the grid is of the order of a few tenths of a millimeter, the opening of the meshes being of the order of a few millimeters. Tests carries out by the applicant have shown that such a grid ensures quite satisfactorily the independence of the two flows of liquid while allowing the micro-bubbles to pass.

According to improvements also coming within the scope of the invention, the flotation apparatus comprises a device for ensuring a uniform flow of the treated liquid at the outlet of the treatment chamber. It comprises furthermore a device for ensuring the uniform flow of the treatment water at the outlet. In the same way moreover as the treatment water, the treated water which already circulates without turbulence from the inlet to the neighbourhood of the outlet, circulates again without turbulence as far as the outlet itself, which may prove advantageous if it still contains some floccules to be removed at this place.

Furthermore, owing to this arrangement and especially owing to the fact that the inlet for the treatment water is at the same level as the inlet for the water to be treated, the amount of micro-bubbles released by the treatment water under high compression is considerable at the beginning of the treatment and decreases steadily along the length of the chamber; the amount of micro-bubbles is then always proportional to the amount of floccules present in the water to be treated, an amount which is also very considerable in the neighbourhood of the inlet and which decreases steadily along the whole length of the chamber.

An embodiment of the present invention is shown by way of example in the accompanying drawing in which the only FIGURE is a schematical sectional view of a flotation apparatus.

The apparatus shown is formed by a parallelepipedic treatment chamber 1 open at its upper part and formed, in addition to its side-walls, from an inlet wall 2, an outlet wall 3 and a bottom 4.

The inlet wall 2 receives an inlet 5 for the water to be treated which may be formed, for example, by a parallelepipedic pipe and which is topped by a gutter 6 formed by the upper part of the inlet wall 2, the lower part of inlet 5 and a transverse plate 7, this gutter being closed at one of its ends.

It will be noted that at its lower part, inlet 5 is extended by a horizontal plate 8 above which is disposed the inlet 9 for the water under high compression provided with a series of nozzles 10. Outlet wall 3 is provided upstream with a flow plate 11 resting on bottom 4 and forming with the wall itself and two horizontal separation walls 12 and 13, two outlet chambers 14 and 15. In a way known per se, plate 11 is provided with apertures dimensioned, taking into account their height so that the same amount of liquid flows through each of them. Chamber 14 is connected by an outlet pipe 16 and chamber 15 to a recycling pipe 17. Finally, in the extension of plate 8, there is disposed a grid 18 which divides the treatment chamber into two parts. This grid may be a metal grid formed from wires having a diameter of two tenths of a millimeter and comprising meshes having openings of two millimeters for example.

The apparatus thus described operates in the following way.

The liquid to be treated coming from inlet 5 in the direction of arrow $F_1$ penetrates into treatment chamber 1 from left to right. According to the FIGURE, it leaves chamber 1 through the apertures of plate 11 and leaves the apparatus in the direction of arrow $F_2$.

The treatment liquid is ejected under a pressure of the order of a few bars, 7 bars for example, by nozzles 10 in the direction of arrow $F_3$; the depressurisation which it undergoes allows the gas which it contains to be released in the form of micro-bubbles. This liquid then moves rightwards to reach plate 11, chamber 15, then recycling pipe 17 and finally a recycling apparatus in the direction of arrow $F_4$. Owing to grid 18, and in accordance with the findings of the applicant, the two flows of liquid discussed hereabove both move from the left to the right without interference with one another.

It is however preferable that the flow rates of the two flows are not too disproportionate with respect to each other.

Since, moreover, the water to be treated arrives without turbulence and leaves without turbulence owing to plate 11, the result is that this water to be treated circulates in the whole of the apparatus without the slightest turbulence.

On the other hand, it is clear that the amount of micro-bubbles emitted by the treatment water is considerable in the neighbourhood of nozzles 10, then decreases steadily along the length of the chamber. These bubbles which pass freely through grid 18 will then carry along a large amount of floccules in suspension in the water in the neighbourhood of the inlet and their amount will thus always be proportionate to the number of floccules remaining to be removed; these floccules carried along by the micro-bubbles thus reach the upper level of chamber 4 to form sludge 19 which flows over the upper edge of the inlet wall 2. There results, at 20, a deposit in gutter 6, this deposit being removed either from one side or the other of the apparatus. It is possible to provide, in a conventional way, mobile scrapers facilitating the removal of the sludge, should that be necessary.

Similarly, known systems allowing the removal without turbulence of water downstream may be used in place of plate 11. For example, it is possible to use advantageously the devices forming the subject of French Pat. No. 74.27355 of 31st. July, 1974.

All things considered, there is thus removed from the water to be treated the whole of the floccules in suspension, since, on the one hand, owing to the absence of turbulence the floccules are never broken and, on the other hand, at each level the amount of active micro-bubbles corresponds to the amount of floccules to be removed.

Finally, it will be noted that the water to be treated remains separated from the treatment water, which allow this latter to be recycled and the efficiency to be improved since dilution is avoided.

Tests have proved that it is thus possible to appreciably increase the speed of treatment of the water, owing to which the same quantity of treated water can be treated with apparatus of much reduced size. Speeds of 8 to 15 m3/hour/m2 of horizontal surface can readily be obtained with an apparatus conctructed in accordance with the invention.

Another embodiment of the invention allows the grid 18 to be dispensed with. According to this embodiment, a flow regulator R is disposed in piping C connecting recycling pipe 7 to inlet 9 for the treatment water. It has however been discovered that when the grid 18 is dispensed with, the water under high compression which is ejected from inlet 9 at a fairly high speed, tended to cause some turbulence which has repercussions on the flow of liquid to be treated. This is why, instead of inlet 9 for water under high compression provided with nozzles 10, it has been preferred to use an inlet formed by a tube split over the whole of its length at its front part. This tube can, for example, have a square section, in which case the slit would advantageously be just below the level of the upper right-hand edge of the tube, the upper wall of this latter being possibly slightly extended so as to form a sort of visor above the slit. Thus, as has already been pointed out previously, the water under high compression undergoes a partial prior expansion in said tube before flowing therefrom at a reduced speed not likely to cause turbulence.

Piping C comprises of course also a member P for preparing the water which compresses it and charges it with air for producing micro-bubbles. This apparatus is not described for it is quite conventional. The purpose of regulator R is to cause the amount of treatment water which will flow from the inlet of water under high compression to be a fraction of the amount of treated water in circulation equal to the ratio between the two sections $S_1$ and $S_2$. By sections $S_1$ and $S_2$ is understood the sections of the chamber respectively above and below the horizontal plane defined by the low part of inlet 5 and plate 8 which extends it. Owing to the action of this regulator, the liquids will circulate in the two parts of the chamber without interfering with each other and experience has shown that from the inlet to chamber 1 as far as the outlet, the two flows of liquid remain distinct, owing to which it is possible to dispense with grid 18 and obtain the same advantages as above without the micro-bubbles released by the treatment water being braked in any way.

What is claimed is:

1. A process for separating matter in suspension in a liquid in a flotation apparatus comprising a treatment chamber provided, at one of its ends, with an inlet for the liquid to be treated circulating without turbulence and, at the other end, an outlet for the treated liquid, an inlet pipe for the treatment water under high compression charged with gas being disposed at the lower part of said treatment chamber, characterized in that said inlet pipe for the water under high compression is located below and in the neighborhood of the inlet for the liquid to be treated in the treatment chamber, an outlet pipe for the treatment water being disposed at the lower part of the chamber, below and in the neighborhood of the outlet of the treated water comprising causing the liquid to be treated and the treatment fluid of the same density charged with bubbles to circulate in two superimposed, distinct and parallel flows so that the bubbles contained in said fluid pass through said liquid to be treated so as to float particles in said liquid to be treated.

2. A process according to claim 1, characterised in that the liquid to be treated forms the upper flow, the lower flow being water under high compression charged with gas, particularly air.

3. A flotation apparatus comprising a treatment chamber provided, at one of its ends, with an inlet for the liquid to be treated circulating without turbulence and, at the other end, an outlet for the treated liquid, an inlet pipe for the treatment water under high compression charged with gas being disposed at the lower part of said treatment chamber, characterised in that said inlet pipe for the water under high compression is located below and in the neighbourhood of the inlet for the liquid to be treated in the treatment chamber, an outlet pipe for the treatment water being disposed at the lower part of the chamber, below and in the neighbourhood of the outlet of the treated liquid, means allowing the passage of the micro-bubbles coming from the water under high compression being furthermore provided to create between the two ends of the chamber, two distinct, superimposed and parallel flows, the upper one for the liquid to be treated, the other lower one for the water under high compression.

4. A flotation apparatus according to claim 3, characterised in that the means for creating two distinct, superimposed and parallel flows comprise a device for regulating the flow of water under high compression adjusted so that the flow rate of this water is equal to the flow rate of the liquid to be treated.

5. A flotation apparatus according to claim 4, characterised in that the inlet pipe for the water under compression is formed by a tube fed with water under high compression whose axis is perpendicular to the direction of movement of the liquid to be treated, this tube being split over the whole of its length so that the water under high compression flows therefrom in a direction substantially parallel to the direction of movement of the liquid to be treated.

6. A flotation apparatus according to claim 5, characterised in that said tube has a square section, the slit being just under the level of the upper edge of the tube.

7. A flotation apparatus according to claim 6, characterised in that the upper wall of the tube is extended for a small distance so as to form a visor above the slit.

8. A flotation apparatus according to claim 3, characterised in that the means for creating two distinct, superimposed and parallel flows comprise a grid disposed between the flow of liquid to be treated and the flow of water under high compression.

9. A flotation apparatus according to claim 8, characterised in that the diameter of the wires forming the grid is of the order of a few tenths of a millimeter, the opening of the meshes being of the order of a few millimeters.

10. A flotation apparatus according to claim 4, characterised in that it comprises a device ensuring a uniform flow of the treated liquid at the outlet of the treatment chamber.

11. A flotation apparatus according to claim 4, characterised in that it comprises also a device ensuring a uniform flow of the treatment water at the outlet.

* * * * *